United States Patent [19]

Stehle et al.

[11] 3,950,873

[45] Apr. 20, 1976

[54] SUPPORT POST FOR USE WITH A PLURALITY OF TRAFFIC WARNING DEVICES

[75] Inventors: John J. Stehle, Bensenville; Robert E. Davis, Barrington, both of Ill.

[73] Assignee: Best Barricade Company, Chicago, Ill.

[22] Filed: Apr. 22, 1975

[21] Appl. No.: 570,487

[52] U.S. Cl. ..... 40/125 H; 116/63 P; 256/64

[51] Int. Cl.[2] ..... E01F 9/01; G09F 7/18

[58] Field of Search ..... 116/63 P, 63 T; 40/125 H, 125 N, 145; 404/10, 9; 256/64; D96/12 H; 403/252; 248/165

[56] References Cited

UNITED STATES PATENTS

| | | | |
|---|---|---|---|
| 1,998,520 | 4/1935 | Penote | 256/64 |
| 3,089,682 | 5/1963 | Parker | 256/64 |
| 3,456,100 | 7/1969 | Green | 256/64 |
| 3,862,523 | 1/1975 | Eaton | 256/64 |
| 3,877,681 | 4/1975 | Humphrey | 256/64 |

FOREIGN PATENTS OR APPLICATIONS

| | | | |
|---|---|---|---|
| 416,712 | 1/1967 | Switzerland | 116/63 P |

*Primary Examiner*—Richard C. Queisser
*Assistant Examiner*—Daniel M. Yasich
*Attorney, Agent, or Firm*—Barry L. Clark

[57] ABSTRACT

Hollow molded plastic support member for use in forming a variety of traffic warning devices has an inverted Y-shape which forms a pair of spaced angled legs and a vertical post portion. The post portion includes a pair of vertically elongated, spaced apertures defined by integral plastic connecting walls which space the opposed planar side portions of the support member from each other. An opening in the post portion permits ballast to be loaded into the hollow interior of the legs. A single support member can be used in combination with a vertical member having portions which snap fit with the apertures to form a three-legged sign or light support. Pairs of support members can be used with a variety of disclosed cross bar arrangements to form barricades and warning signs. The snapfit design of several of the disclosed warning devices permits the devices to come apart when hit by a vehicle without causing damage to either the vehicle or the warning device.

14 Claims, 9 Drawing Figures

SUPPORT POST FOR USE WITH A PLURALITY OF TRAFFIC WARNING DEVICES

BACKGROUND OF THE INVENTION

The invention relates to warning signs and barricades of the type used beside roadways during construction to provide information or to channelize traffic. Conventionally, such devices are made of wood and/or metal and have an inherently high center of gravity. To make them stable, sand bags are usually laid over their cross bars or stacked around their bases. Unfortunately, the sand bags are often not used, or they break or are stolen, leaving the warning device susceptible to being blown over by the wind or by the suction induced by passing vehicles. Once a device falls, it can of course provide no warning and it also presents a danger in that it can be struck by a vehicle, causing damage to itself as well as to the vehicle and sometimes to the occupants therein.

A folding hollow plastic barricade which overcomes the problems of the prior art wood and metal barricades is disclosed in our copending U.S. Pat. application Ser. No. 488,531 filed July 15, 1974, now U.S. Pat. No. 3,880,406. It would be most advantageous if the improvements in safety provided by our folding plastic barricade could be extended to other types of warning devices, including non-folding barricades. It is the object of the present invention to provide a series of warning devices, each utilizing a common hollow plastic support member, and which are safer than prior art wood and/or metal devices; are less susceptible to being blown over by the wind; are lighter in weight and easier to carry; and are in most cases undamaged by impact.

SUMMARY

The present invention is concerned with a support member or post which is formed in such a manner that it can be used, either singly, or in combination with an identical support member, to support a large variety of members which incorporate warning indicia. The support member is made of hollow molded plastic in a generally inverted Y-shape by blow molding or rotocasting, for example. Any plastic can be used which will stand up to exposure to the elements, and polyethylenes of the low density, high density and cross linking types have been found to be quite suitable. A hole in one side of the member permits sand or other ballast to be inserted to fill the hollow interior. Suitable dimensions for the support member include a height of about 43½ inches, a width between the tips of the legs of 32 inches, a post width of 4¾ inches, and an overall thickness of 1¾ inches. A pair of elongated vertical apertures in the post portion have side walls integral with the post which connect its two flat sides and lend additional rigidity to the support member. The apertures are preferably about 1 15/32 inches wide near one side of the support so that they will be resiliently compressed to tightly engage nominal 2 inch lumber having a thickness of about 1½ inches or more which might be used with them. The top aperture has a height of 8⅝ inches so that when a pair of supports is used to support the ends of a conventional 2 × 8 inch board which is 7⅝ inches wide in a barricade arrangement, the supports will be in locking engagement with the board at opposed upper and lower corners of the apertures when tilted about 20° from the vertical. By making the aperture side walls at an angle of about 3° to a line normal to the planar side surfaces of the support member, a tapered lead-in portion is provided to guide a cross member into the aperture.

The support member can be used in a great variety of configurations. For example, a single support member can be used in combination with a vertical panel or light support member having a single leg and a pair of aperture engaging portions. A pair of support members can be used in combination with a single cross bar to form a Type I barricade or with a double cross bar to form a Type II barricade. The cross bar arrangement connecting a pair of supports can be of a form having a V-shaped opening for receipt of a warning sign or can have integral pockets for supporting a sign or light carrying post. The cross bar can be solid or hollow. One particularly suitable form is structural foam such as polyethylene, polypropylene or polycarbonate which, in the case of a single cross bar, could be extruded in any generally 2 × 8 inch cross section including a solid member, a hollow member, an I-beam, or a channel, for example. Where the cross bar structure is designed to fit into both apertures in a support member, it preferably includes complementary arm like extension portions with enlarged ends which are adapted to pass through the apertures. The enlarged ends provide a snap fit relative to the apertures so as to lock the cross bar to the support members.

DESCRIPTION OF THE PREFERRED EMBODIMENTS

Figure 7:
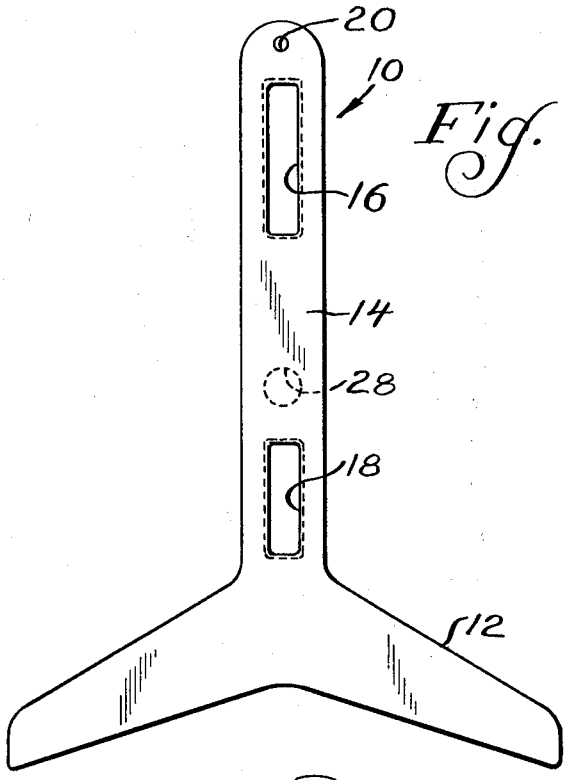
FIG. 7 is a side view of our novel support member.

Referring to the drawing, FIG. 7 shows the support member 10 which is utilized in the five embodiments of the invention illustrated in the remaining figures. The support member 10 includes a pair of angled leg portions 12 and an integral post portion 14 which includes an upper cross bar support aperture 16 and a lower cross bar support aperture 18. A hole 20 at the top of post portion 14 is adapted to receive a fastener 22 which may support a conventional flasher assembly 24 when the member 10 is used in the Type II (two cross bars) barricade configuration shown in FIG. 1. An opening 28 in one side of the post portion 14 permits sand 30 or other ballast to be placed in the hollow interior of the member 10 as can be seen in the broken away portion of FIG. 5. The sand lowers the center of gravity of the support member and can often provide enough weight to the device so as to eliminate the need for sand bags.

Figure 1:
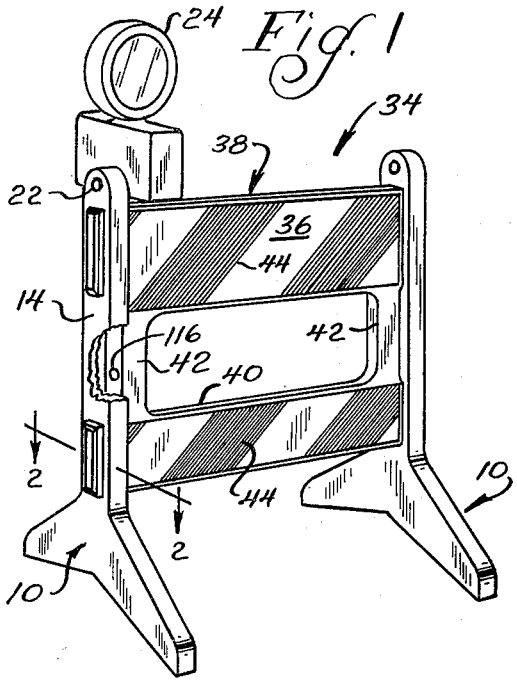
FIG. 1 is a perspective view of a Type II barricade utilizing our novel support members.
Figure 2:
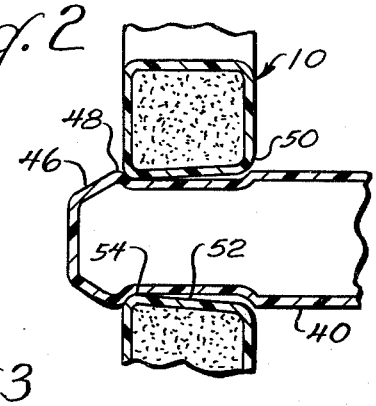
FIG. 2 is an enlarged sectional view taken on line 2—2 of FIG. 1.

FIG. 1 illustrates a Type II barricade 34 formed of a pair of support members 10 and a cross bar section 36. The cross bar section 36 has an upper cross bar 38, a lower cross bar 40, and vertical connecting portions 42. If desired, a hole (not shown) can be formed in one of the vertical portions 42 so that sand or other ballast can be placed inside the hollow interior of the cross bar 40. A reflective warning tape 44 is applied to the surface of cross bar 38 and is preferably slightly recessed to help protect its edges from the elements and from vandals. As can be seen in FIG. 2, the cross bar 36 includes specially shaped ends at the ends of cross bars 40, 38 which include a tapered end portion 46 and an adjacent enlarged portion 48. The tapered portion 46 is adapted to guide the cross bar 40 as it is manually pushed against the wide entrance portion 50 of the aperture 18, along its tapered side walls 52, and past the resilient narrow exit portion 54 with which the enlarged portion 48 cooperates to provide a snap fit. The snap fit arrangement makes for easy assembly and disassembly of the unit 34 and permits the unit to come apart without damage when struck by a vehicle. If one desires to hold the unit together more firmly, a fastener (not shown) can be provided to connect the post portion 14 to the vertical cross bar portion 42.

Figure 3:
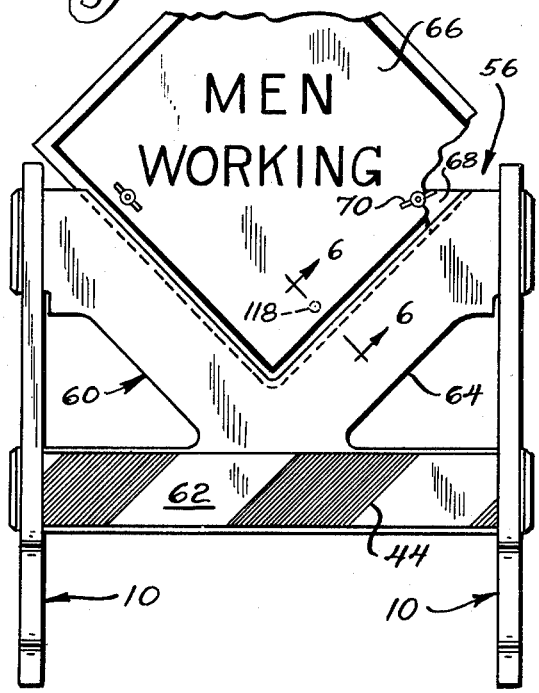
FIG. 3 is a front view of a saddle type sign holder utilizing our novel support members.
Figure 6:
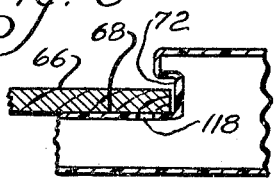
FIG. 6 is an enlarged sectional view taken on line 6—6 of FIG. 3.

FIGS. 3 and 6 illustrate a saddle type sign stand 58 which is a modification of the FIG. 1 device. The cross bar portion 60 has a lower cross bar portion 62 which is identical to lower cross bar 40 in the way in which it attaches to support members 10. The upper portion 64 is generally V-shaped so that it can support a 36–48 inch sign 66 which may be fastened to its rear surface 68 by fasteners 70. A recess 72 is formed in the V-portion 64 to support and retain the sign 66 after the fasteners 70 are in place. The recess is preferably wide enough to accommodate a range of sign thicknesses.

Figure 4:
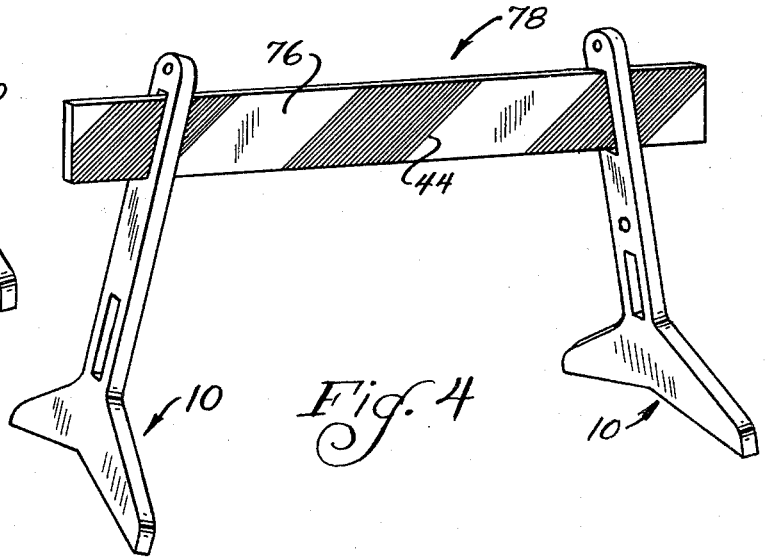
FIG. 4 is a perspective view of a Type I barricade utilizing our novel support members.

FIG. 4 illustrates the use of a pair of support members 10 with a cross bar 76 to form a Type I barricade 78. As previously mentioned, the cross bar 76 can be formed of 2 × 8 (nominal) inch lumber or similar extruded or molded plastic shapes.

Figure 5:
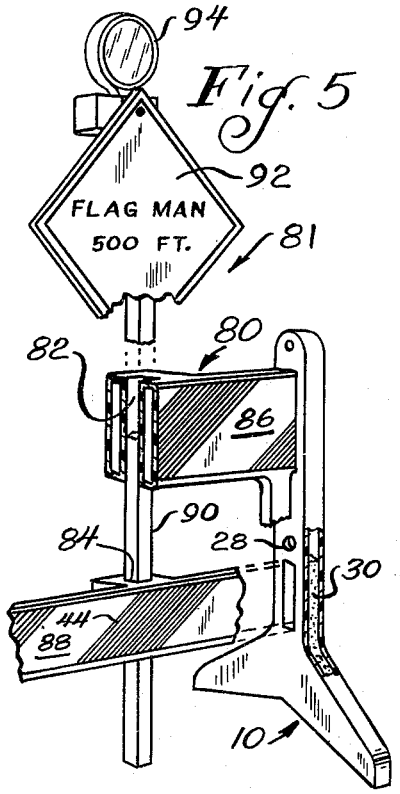
FIG. 5 is a fragmentary perspective view of a high level warning sign utilizing our novel support members.

FIG. 5 illustrates the use of a pair of support members 10 (one of which is not shown) with a cross bar member 80 which is substantially identical to the cross bar 38 of FIG. 1 to form a high level warning sign unit 81. However, the member 80 includes upper and lower apertures 82,84 formed in its upper and lower cross bars 86,88. The apertures 82,84 are adapted to receive a vertical post 90 which has a warning sign 92 and/or light 94 mounted at its upper end.

Figure 8:
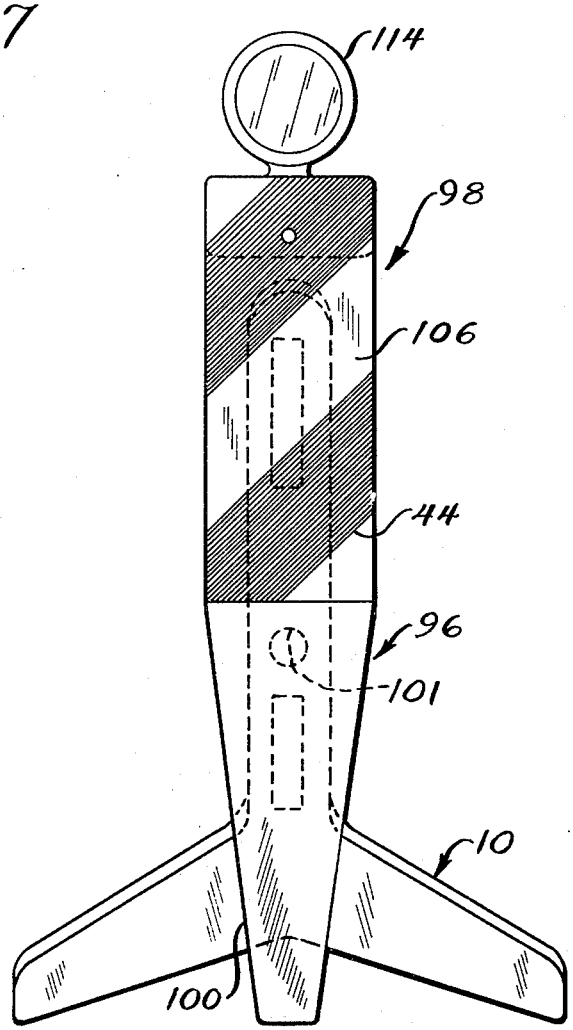
FIG. 8 is a front view of a vertical warning panel utilizing our novel support member.
Figure 9:
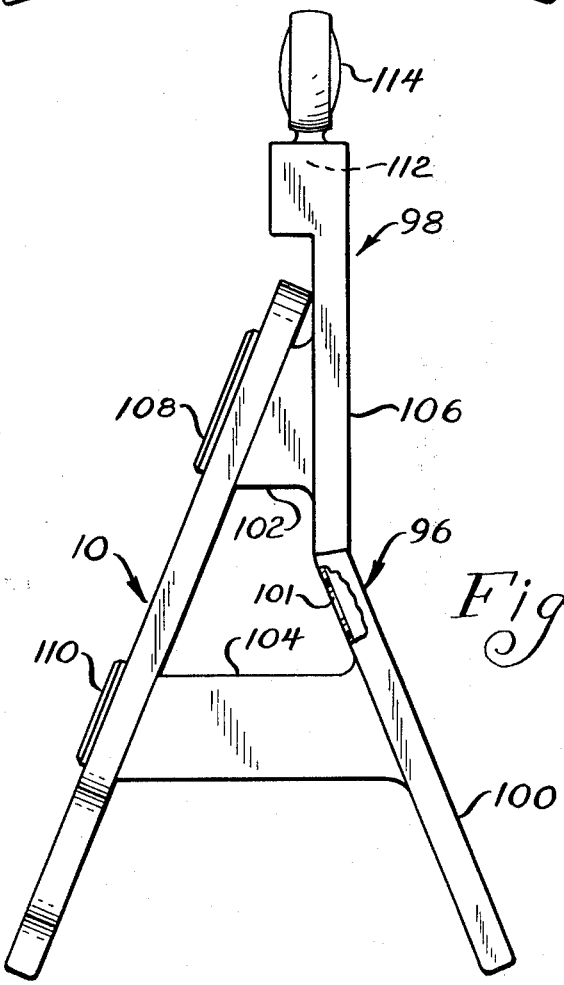
FIG. 9 is a side view of the vertical warning panel of FIG. 8.

FIGS. 8 and 9 illustrate an additional modification of the invention wherein a single support member 10 is used with a vertical panel member 96 to form a vertical panel warning device 98. The panel member 96 includes an angled leg portion 100 which is preferably hollow for the receipt of sand or other ballast through fill hole 101. Upper and lower arm portions 102,104 extend rearwardly from the panel portion 106 and the leg portion 100 and include enlarged ends 108,110 which snap fit with the support post 10 as shown in FIG. 2. The top of panel member 96 is preferably formed as a hollow box 112 which can support a flasher 114.

It is desirable to provide a capability to place sand or other ballast in each of the disclosed warning indicia carrying members which have portions which engage the lower aperture 18 in the support post 10 when such members are hollow. Thus, in FIG. 1, the vertical cross bar portion 42 has a fill hole 116 normally covered by the support post 14. Similarly, the hollow rear portion 68 in FIG. 3 has a fill opening 118 which is normally covered by the sign 66.

We claim:

1. A support post member for selective use with a plurality of traffic warning devices, said support post member being formed of hollow molded plastic and including a pair of parallel, spaced apart planar side portions; said support post member being of a generally inverted Y-shape and having a pair of integral angled legs at its lower end and a post portion at its upper end containing at least two vertically elongated, vertically spaced apart apertures which are formed through said post member on its vertical axis in a direction generally normal to the plane of said planar side portions, each of said apertures being peripherally defined by a plurality of plastic walls which are integrally joined to each other and to said planar side portions so as to connect and space apart the planar side portions; said post member including at least one opening for permitting ballast material to be placed internally of said post member; a pair of said plurality of plastic walls which define the opposed vertical sides of at least one of said apertures having retaining portions for retaining a portion of a warning indicia carrying member which are closer to said vertical axis than are other portions of said pair of walls, at least one of said apertures having a pair of vertical opposed wall portions which define a wider opening through said retaining portions being adapted to be frictionally engaged and resiliently moved away from said vertical axis when a portion of said warning indicia carrying member having a greater thickness than the distance between said retaining portions is moved through said at least one aperture.

2. A traffic warning device comprising at least one hollow molded plastic support post member including a pair of parallel, spaced apart, planar side portions; said support post member being of a generally inverted Y-shape and having a pair of integral angled legs at its lower end and a post portion at its upper end containing at least two vertically elongated, vertically spaced apart apertures which are formed through said post member on its vertical axis in a direction generally normal to the plane of said planar side portions, each of said apertures being peripherally defined by a plurality of plastic walls which are integrally joined to each other and to said planar side portions so as to connect and space apart the planar side postions, one of said planar side portions than through the other of said planar side portions, said post member including at least one opening for permitting ballast material to be placed internally of said post member; and a warning indicia carrying member having a portion thereof passing through and cooperating with portions of at least a pair of opposed walls which help define the upper of said at least two apertures so as to retain said warning indicia carrying member and stabilize said warning device.

3. The traffic warning device of claim 2 wherein said warning indicia carrying member comprises a generally horizontal plank-like member having warning indicia on at least one of its vertically positioned flat sides and a vertical height less than the height of the upper aperture in said post member whereby the post member can be pivoted relative to the plank-like member so that its vertical axis is at an angle of at least about 15° relative to a line normal to the axis of the plank-like member, the upper edge of said upper aperture on one side of said post member and the lower edge of said upper aperture on the other side of said post member cooperating with said plank-like member to lock said members together.

4. The traffic warning device of claim 2 wherein said warning device includes a pair of plastic support post members spaced from each other by said indicia carrying member.

5. The traffic warning device of claim 4 wherein said warning indicia carrying member comprises a pair of vertically spaced horizontal bar portions integrally connected by vertical portions.

6. The traffic warning device of claim 5 wherein said bar portions each include a central vertical aperture adapted to receive a post carrying warning indicia at a level higher than said support post members.

7. The traffic warning device of claim 4 wherein said warning indicia carrying member comprises a lower horizontal bar portion mounted in the lower of said at least two apertures in each support post and a generally V-shaped saddle portion, said saddle portion being integrally attached at its bottom to said horizontal bar portion and having side arm portions at its top which engage in the upper of said at least two apertures in each support post, and means on said saddle portion adapted to cooperate with a flat sign member for retaining it.

8. The traffic warning device of claim 7 wherein said last named means comprises a recessed channel defining the bottom of said V-shaped saddle portion.

9. The traffic warning device of claim 2 wherein the portion of said warning indicia carrying member which is adapted to pass through and cooperate with at least the upper of said at least two apertures has an enlarged portion proximate its outer end which is adapted to be compressed relative to said upper aperture as it is passed through said aperture so as to provide a snap fit.

10. The traffic warning device of claim 9 wherein said enlarged portion is positioned at a short distance from said outer end and joined thereto by a tapered lead-in portion.

11. The traffic warning device of claim 2 wherein said plastic walls which define the vertical sides of said vertically elongated apertures are slightly tapered from one of said planar side portions to the other to facilitate entry of a portion of a warning indicia carrying member therein.

12. The traffic warning device of claim 11 wherein said tapered plastic walls which define the vertical sides of said apertures are formed so as to be closer together where they join one of said planar side portions than the thickness of the portion of a warning indicia carrying member which is adapted to engage them, said plastic walls being resiliently deformed by said warning indicia carrying member.

13. The traffic warning device of claim 2 wherein said warning indicia carrying member comprises a panel member having a vertical warning panel portion, a single leg portion, and a pair of arm portions extending rearwardly from the plane of said panel portion, said arm portions extending through said at least two apertures and interlocking therewith to stabilize and warning device.

14. The traffic warning device of claim 2 wherein said warning indicia carrying member is hollow and has an aperture therein so that ballast may be placed therein.

* * * * *

UNITED STATES PATENT OFFICE

CERTIFICATE OF CORRECTION

PATENT NO. : 3,950,873

DATED : April 20, 1976

INVENTOR(S) : John J. Stehle and Robert E. Davis

It is certified that error appears in the above-identified patent and that said Letters Patent are hereby corrected as shown below:

Column 4, line 30, after "through" insert --one of said planar side portions than through the other of said planar side portions,--.

Column 4, line 49, cancel "positions," and insert --portions; at least one of said apertures having a pair of vertical opposed wall portions which define a wider opening through--.

Column 6, line 29, after "stabilize", cancel "and" and insert --said--.

Signed and Sealed this

*Seventh* Day of *August 1979*

[SEAL]

*Attest:*

*Attesting Officer*

LUTRELLE F. PARKER

*Acting Commissioner of Patents and Trademarks*